United States Patent [19]

Kleefeldt et al.

[11] Patent Number: 4,518,180

[45] Date of Patent: May 21, 1985

[54] AUTOMOBILE POWER DOOR LATCH

[75] Inventors: Frank Kleefeldt, Heiligenhaus; Rolf Raetz, Essen, both of Fed. Rep. of Germany

[73] Assignee: Kiekert GmbH & Co. Kommanditgesellschaft, Heiligenhaus, Fed. Rep. of Germany

[21] Appl. No.: 418,584

[22] Filed: Sep. 15, 1982

[30] Foreign Application Priority Data

Dec. 21, 1981 [DE] Fed. Rep. of Germany ..... 3150620
Dec. 21, 1981 [DE] Fed. Rep. of Germany ..... 3150621

[51] Int. Cl.[3] ..... E05C 3/06

[52] U.S. Cl. ..... 292/201; 292/216; 292/DIG. 49

[58] Field of Search ..... 292/196, 198, 201, 280, 292/213, 216, DIG. 49

[56] References Cited

U.S. PATENT DOCUMENTS

| | | | |
|---|---|---|---|
| 2,189,992 | 2/1940 | Pearce | 292/DIG. 49 |
| 2,325,225 | 7/1943 | Burke | 292/201 X |
| 3,359,767 | 12/1967 | Arlauskas et al. | 292/201 X |
| 3,386,761 | 6/1968 | Johnstone et al. | 292/201 |
| 3,566,703 | 3/1971 | Van Noord | 292/201 X |
| 3,905,627 | 9/1975 | Fujita | 292/216 |
| 4,033,616 | 7/1977 | Sheesley | 292/216 |
| 4,056,276 | 11/1977 | Jarvis | 292/198 X |
| 4,268,076 | 5/1981 | Itoi | 292/201 X |
| 4,364,590 | 12/1982 | Hamada | 292/216 X |

*Primary Examiner*—Gary L. Smith
*Assistant Examiner*—Thomas J. Dubnicka
*Attorney, Agent, or Firm*—Karl F. Ross; Herbert Dubno

[57] ABSTRACT

A power door latch for automotive vehicles in which an electric motor drives a crank to move a slider which, in turn, can act upon a toggle linkage and a pawl so that the latch can release a rotary bolt and a toggle linkage can displace the rotary bolt to latch or release a pin of the doorpost. The toggle linkage allows high friction forces to be readily overcome utilizing a low power motor.

9 Claims, 10 Drawing Figures

AUTOMOBILE POWER DOOR LATCH

CROSS REFERENCE TO RELATED APPLICATION

The present application is related to the commonly assigned copending applications Ser. No. 132,978 filed 24 Mar. 1980 now U.S. Pat. No. 4,364,249, Ser. No. 173,452 filed 30 July 1980 now U.S. Pat. No. 4,357,815 and Ser. No. 292,792 filed 14 Aug. 1981 now U.S. Pat. No. 4,440,006. These applications were copending with commonly assigned U.S. Pat. Nos. 4,320,639 and 4,342,209 which, together with the commonly assigned patents Nos. 3,858,919 and 4,165,112 deal with similar subject matter.

FIELD OF THE INVENTION

Our present invention relates to a door latching device for an automotive vehicle door and, more particularly, to a power latch of the type in which an angularly disposable bolt, preferably having the configuration of a fork, receives a pin on the doorpost of the vehicle as the door is closed and the pin enters a notch in the housing, the bolt is swung into a door-latching position, and the bolt is retained in this position by a pawl until an actuating mechanism opens the latch.

BACKGROUND OF THE INVENTION

Rotary or angularly displaceable bolt forks of the aforedescribed type are commonly used in vehicle door locks and generally are mounted on or in a housing which can be provided with the aforementioned notch or slot and mounted upon an edge of the door which is swung into the closed position to thereby enable a stationary pin on the doorpost to enter the mouth of the fork and, as the door-closing motion continues, the angularly disposed bolt into its latching position in which the pawl is rendered effective to prevent angular displacement of the pivotal bolt in the opposite sense tending to release the pin.

Of course, an actuating mechanism is provided to allow release of the bolt and opening of the door.

Generally between the door and the outer post an elastically deformable seal is provided which creates a compression or friction force contributing to the retention of the bolt against a stop.

The term "bolt" is used here in the sense in which it is generally employed in the lock field to refer to the latching member which holds the door closed. In the present invention, this bolt may be a plate angularly displaceable on a housing of the lock mechanism. The housing itself may be any support which can be provided for the lock mechanism and may be a casing, if desired, although it may simply be a mounting plate provided with a notch or slot for the pin.

The stop for the bolt generally is a detent or rest and usually is the main detent of the system which can also be provided with safety detent, i.e. a detent constructed and arranged to prevent undesired opening of the latch. A predetent may also be provided to allow latching of the bolt in a partially closed position or preliminary latching of the bolt.

In practice, a door latching mechanism for motor vehicles of the aforedescribed type exposes the rotary bolt and the pawl, together with the housing, to considerable stress during the closing operation and while the door is held in the closed state. In spite of such stresses, the elements must be capable of withstanding the forces to which they are exposed if the door is to be safely held closed.

The actuating mechanism which must be used in such systems has a large number of levers and other elements for manual operation including handles on the interior and exterior of the door, levers for locking the actuating device, etc. In addition, the actuating mechanism frequently has to overcome the substantial friction forces with which the pawl is held as the closing stop or abutment against the rotary bolt.

All of these considerations have made earlier systems to a greater or lesser extent unreliable.

Power door locking mechanisms for automotive vehicles have also been proposed with an electric motor in the locking-actuating mechanism so that manual operation is not necessary and the door may be opened merely by the operation of a switch or push button controlling the motor.

In these systems, however, rotary bols and pawls of the type previously described cannot be utilized and a different approach to engagement of the pin is used. For example, in such systems the pin can be engaged between the levers of tongs or the like spreadable by the motor when the door is to be opened.

These systems are far less robust than the rotary bolt arrangements and indeed door locks of this type are less secure and in many emergency situations uncontrolled opening of the door may occur.

However, it has not been possible heretofore to simply apply electric motors to rotary bolt locking mechanisms because, when such efforts were made, the high friction forces with which the pawl was held against its abutment on the rotary bolt could not be overcome by motors of reasonable size, and motors dimensioned to overcome such forces could not be accommodated in the door lock structures.

OBJECTS OF THE INVENTION

It is therefore, the principal object of the present invention to provide a robust, safe and effective vehicle door lock which can be operated with an electric motor of lower power.

Another object of the invention is to provide an improved power door lock which overomes the disadvantages of the earlier systems at comparatively low cost.

Still another object of this invention is to provide a motor actuated vehicle door lock which is reliable, compact, simple and inexpensive to manufacture and maintain.

SUMMARY OF THE INVENTION

These objects and others which will become apparent hereinafter are attained in accordance with the present invention in a locking mechanism which comprises a rotary bolt fork adapted to receive the pin of the doorpost, a pawl pivotally mounted on the housing and engageable with this bolt for retaining it in its closed position, spring means urging the pawl into engagement with the bolt or retaining it in its latched position, an actuating member slidable on the housing and provided with a pair of spaced apart abutments, a toggle linkage between these abutments including a pair of articulated members biased into at least one of its two stable positions, the toggle linkage being pivotally connected to the bolt so when in one position to one side of its dead point position the bolt is retained in its locked position while in movement to the other side of the dead point position, the toggle linkage rotates the bolt to free the pin and a crank driven by an electric motor connected to the sliding member for shifting same so that at least one of the abutments displaces the linkage and swinging of the latter is permitted to either side of the dead point position. The other abutment can engage the pawl to swing it away from the rotary bolt.

The invention thus is able to utilize a small electric motor of low power and current demand since the motor acts via the crank and the sliding lever on a toggle linkage having considerable force multiplying character and readily capable of overcoming any friction forces which might otherwise resist the opening of the bolt.

BRIEF DESCRIPTION OF THE DRAWING

The above and other objects, features, and advantages of the present invention will become more readily apparent from the following description, reference being made to the accompanying drawing in which.

SPECIFIC DESCRIPTION

Figure 1:
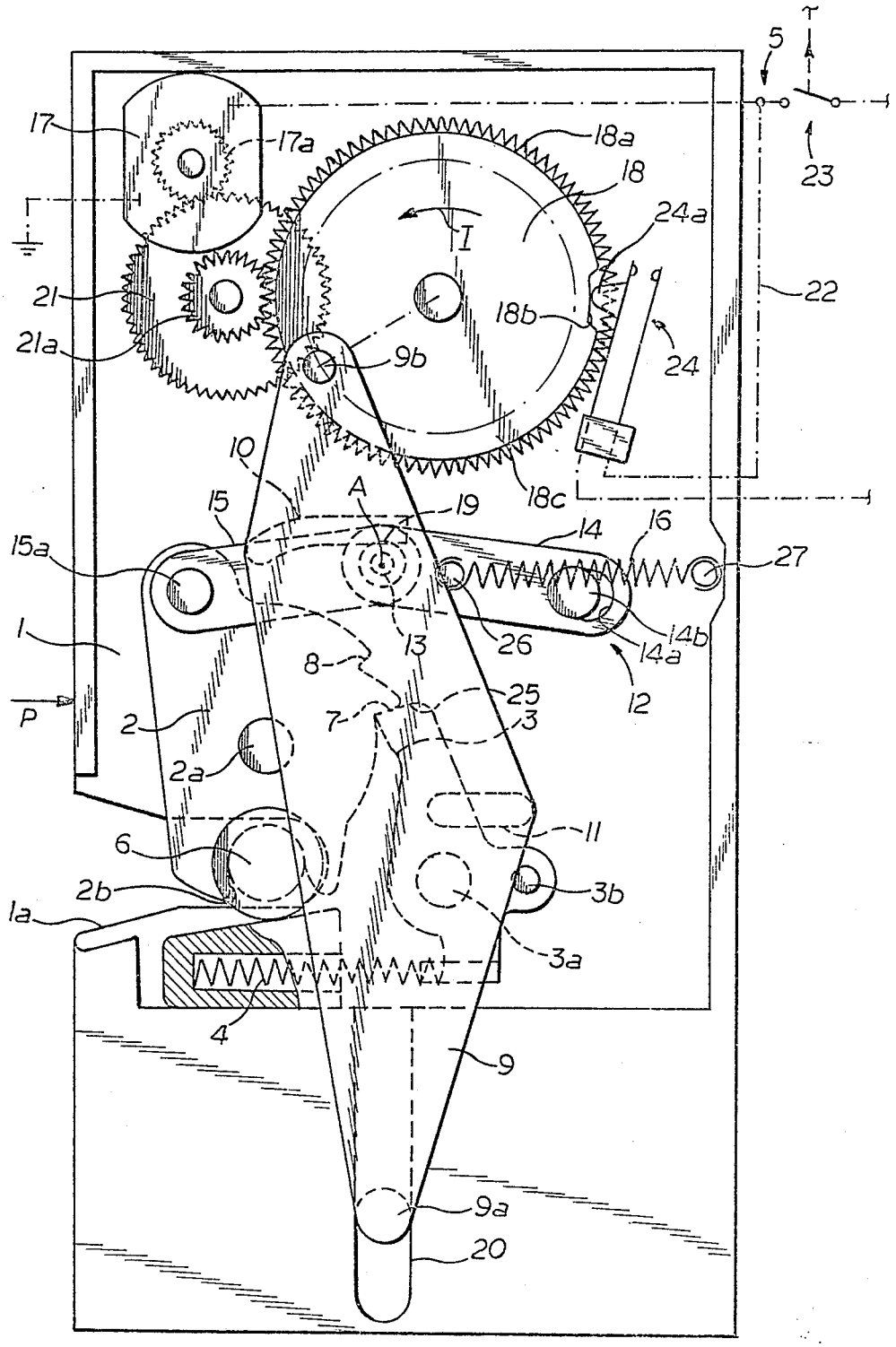
FIG. 1 is an elevational view of a door lock for a vehicle door as viewed in the direction of the edge of the door, illustrating the lock in its closed position preparatory to the commencement of the lock-opening operation.

FIGS. 1–5 show a door-latching device for a vehicle door, according to the invention, which comprises a housing 1 which can be mounted on the edge of the door (not otherwise shown) and provided with a notch or slot 1*a* into which a pin 6 of the doorpost is guided when the door is swung into its closed position.

The doorpost also has not been shown and, in general, between the doorpost and the door an elastomeric seal is provided for weatherproofing purposes, vibration damping purposes and/or to provide a friction force which is translated by the mechanism into a force between the pawl and the rotary bolt when the pawl latches the rotary bolt in its closed position.

The rotary bolt 2 is pivotally mounted on the housing 1 to rotate about the pivot pin 2*a* and is formed with a fork 2*b*, adapted to receive the pin 6. Thus, as the door is closed the pin enters the fork 2*b* (FIG. 3) and rotates the bolt 2 in the counterclockwise sense about the pin 2*a* into the closed position.

In the closed position, the bolt 2 has its main abutment rest or detent 7 engaged by an end 25 of the pawl 3 which is pivotally mounted at 3*a* on the housing 1 and has a pin 3*b* which can be engaged by an abutment 11 of a slider 9 to be described in greater detail below.

The pawl 3 is biased by a spring 4 in its counterclockwise sense (FIG. 1) so that it tends to swing toward the bolt 2.

An actuating device generally represented at 5 is provided for opening the latch and, as is also described below, possibly for closing the latch.

The friction force resulting from the elastically deformable door seal is represented by the arrow P and is a friction force between the surfaces 7 and 25.

In addition to the main detent 7, the bolt 2 has a predetent 8 or a safety detent which is engaged by the pawl 3 to still retain the pin 6 even if, for some reason, the pawl fails to engage the main detent or slips therefrom.

The actuating device 5 is a motor driven actuating device and basically comprises a sliding member or slider 9 which is mounted, e.g. by pin 9*a* which slides in a groove 20 of the housing 1, to move upwardly and downwardly relative to the housing.

The slider 9 is formed with two spaced apart abutments 10 and 11 disposed on opposite sides of a toggle arrangement 12.

Figure 3:
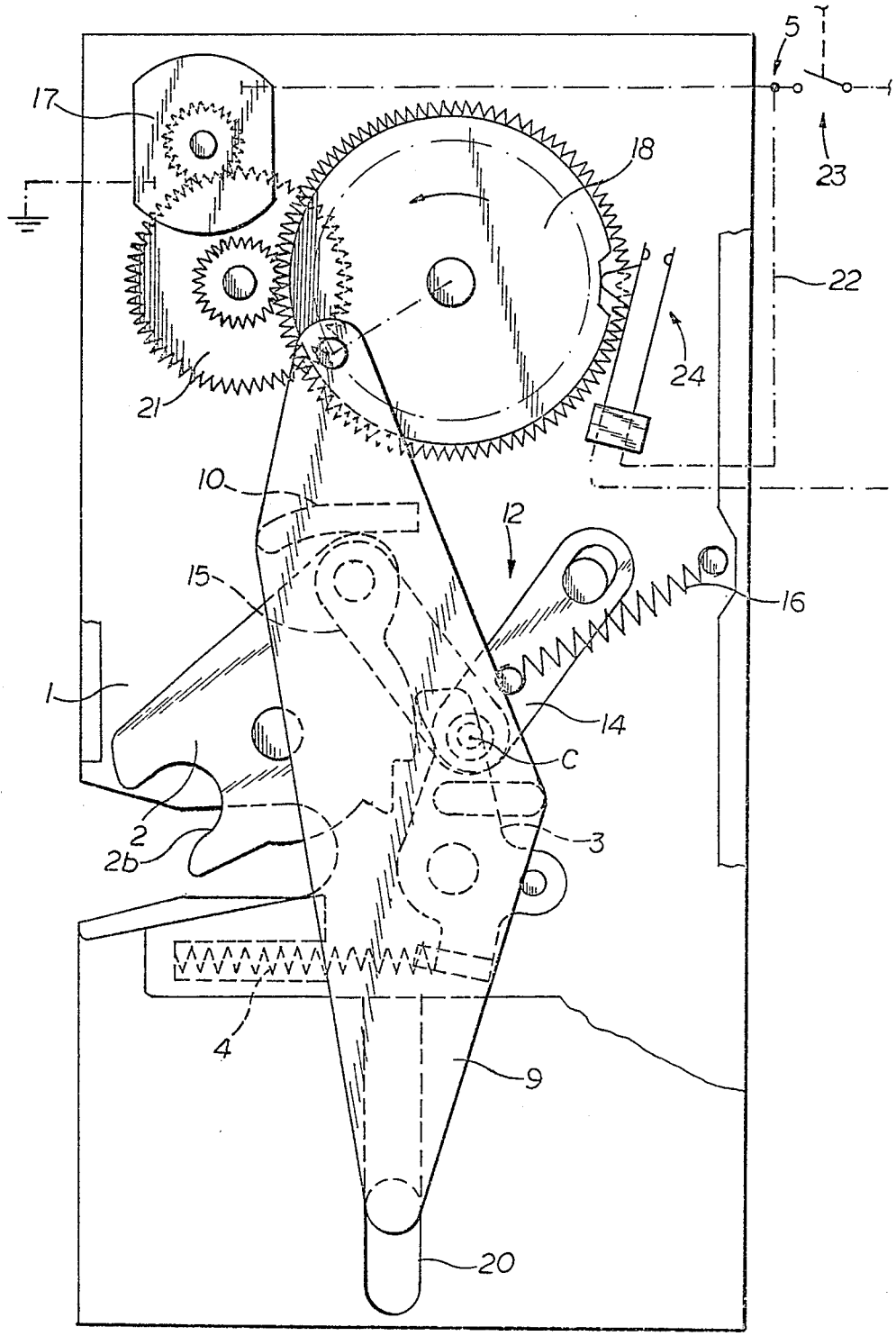
FIG. 3 is a similar view showing the lock in its open position, the electric motor having completed its latch-opening operation.

The toggle arrangement 12 comprises a dead point pivot 13 between a pair of levers 14 and 15 which are biased by a spring 16 into either of the stable positions of this linkage, the upper stable position being shown in FIG. 1 while the lower stable position is shown in FIG. 3, for example.

The link 14 is formed with a slot 14*a* receiving a pin 14*b* by which the lever 14 is swingably mounted on the housing. The lever 15 is pivotally connected at 15*a* to the bolt 2.

At its upper end, the slider 9 is pivotally connected at 9*b* to a combined crank arrangement and cam represented diametrically at 18.

The electric motor 17 has a pinion 17*a* which meshes with a large diameter gear 21 connected to a small diameter gear 21*a* in mesh with a gear 18*a* coupled to the crank, the meshing gearing forming a speed-reducing, torque-increasing transmission.

Since the toggle linkage 12 is pivotally connected at one end of the bolt 2, and at the other end of the housing 1, but could be held in its upper position A by the spring 16 which is anchored between pins 26 and 27 on the link 14 and on the housing, respectively. The line connecting the pins 26 and 27 lies above the pivot 14*b* in this upper position of the linkage and bolt 2, the pivot in the lower position thereof.

In the position A shown in FIG. 1, the spring 16 is effective to hold the bolt 2 in its clockwise sense thereby maintaining the door closed.

When the motor is energized e.g. by operation of the switch 23, the battery is temporarily connected to the motor 17 and the latter is driven to rotate the crank 18 in the counterclockwise sense represented by the arrow T.

Simultaneously, notch 18*b* of the cam driven by the gear 18*a* is rotated past a cam follower 24*a* so that the contacts 24 are closed to continue the connection of the motor 17 to the battery and allow the release of switch 23 which then opens.

Figure 2:
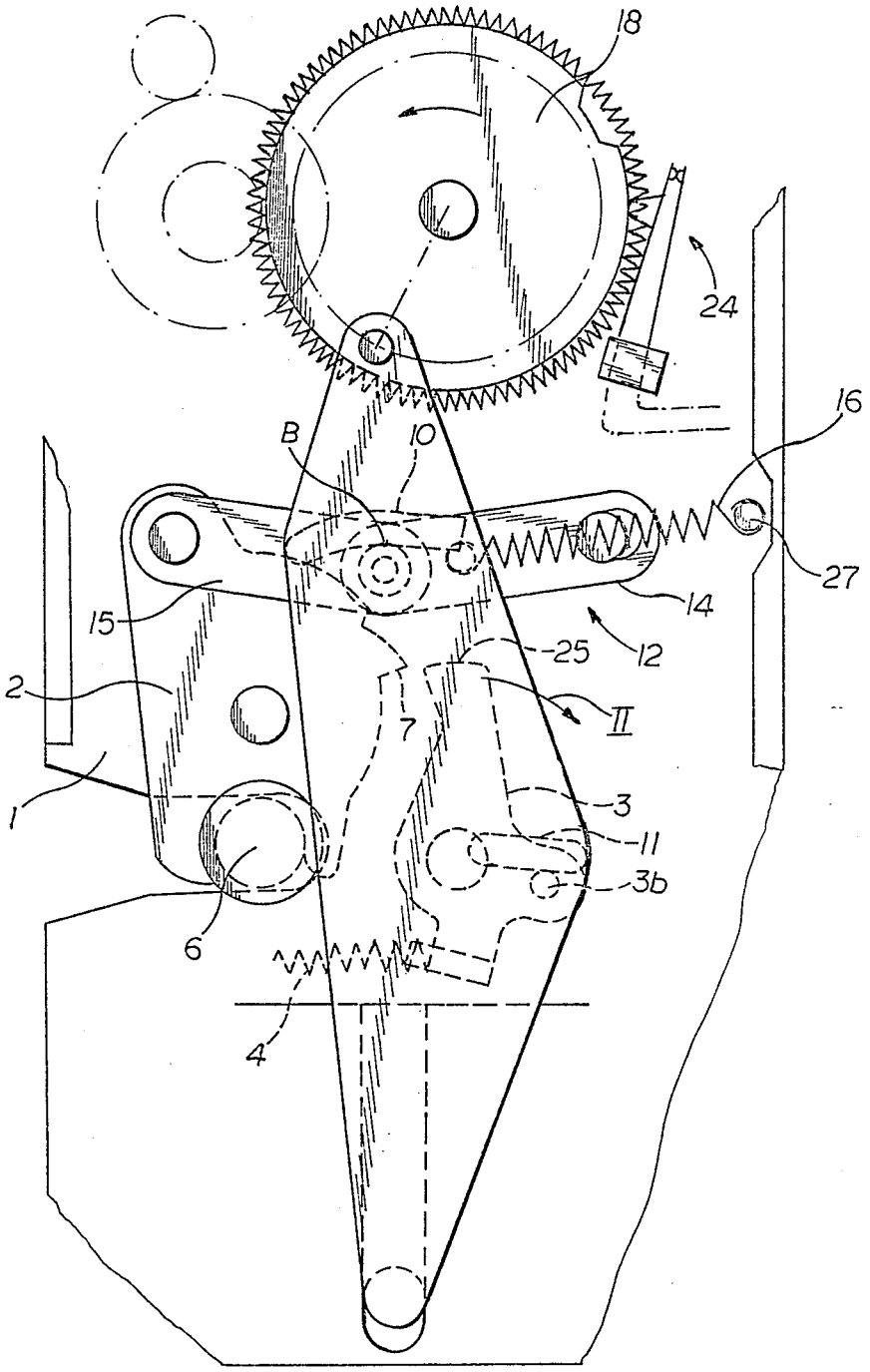
FIG. 2 is a diagram of a portion of the mechanism of FIG. 1 shown in a further position in which the toggle linkage of the invention is about to pass through its dead point position.

The rotation of the crank 18 in the counterclockwise sense, displaces the slider 9 downwardly and to the right, thereby causing the abutment 10 to engage the pivot 13 and displace the latter into the dead center position B shown in FIG. 2 at which the abutment 11 engages the pin 3*b* and swings the pawl 3 in the clockwise sense (arrow II) out of engagement with bolt 2.

As the slider 9 continues its descent the abutment 10 entrains the pivot 13 downwardly past its dead center position into the position showin in FIG. 3, thereby rotating the bolt 2 in the clockwise sense, releasing the pin 6 and allowing the door to open.

The crank continues its rotation until the cam follower 24*a* drops into the notch 18*b* again, lifting the slider 9 and bringing the latter into the position shown in FIG. 3, i.e. the open position.

In this position, the spring 16 holds the linkage 12 below its dead center position, i.e. in the position C.

When the door is again closed, the pin 6 slips into the fork 2*b* (FIG. 3), thereby rotating the bolt 2 in the counterclockwise sense of swinging the linkage 12 upwardly until the position shown in FIG. 1 is resumed, this movement being effected without operation of the crank.

The length of slot 20 thus can accommodate this movement of the slider 9.

The motor 17 thus can be a unidirectional motor which rotates the crank through 360° after energization. In the closed position of FIG. 1, the levers 14, 15 of the toggle linkage 12 include an obtuse angle approaching 180° with one another and such that the motor, for opening of the latch initially tends to draw the levers out so that this angle is 180° in the dead center position B. In this operation, the bolt 2 is initially moved in its closing direction which tends to pull surface 7 from the surface 25 and thereby reduce the friction force between the pawl 3 and the bolt 2.

The abutments 10 and 11 of the slider are so disposed that as soon as the dead center position B is passed in the opening direction, the pawl 3 is drawn away from the bolt 2 before the latter moves further in the opening direction (FIG. 2).

The spring 16 is so positioned that, at the latest in the dead center position, a torque is applied to the lever 14 to the right (FIG. 1) and the left (FIG. 3) for the closing and opening movements.

Figure 4:
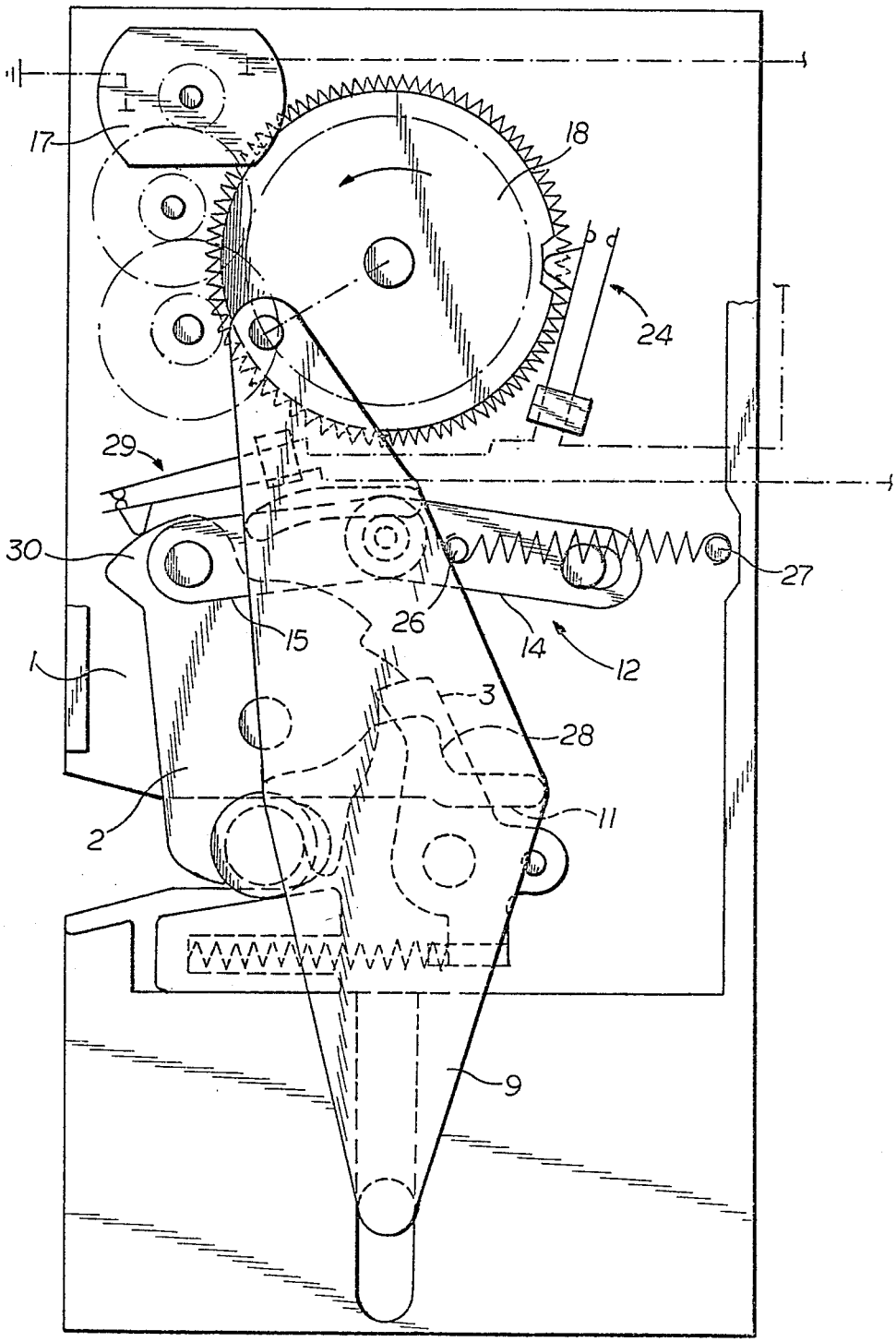
FIG. 4 is a similar view illustrating the utilization of the electric motor for the closing operation as well.
Figure 5:
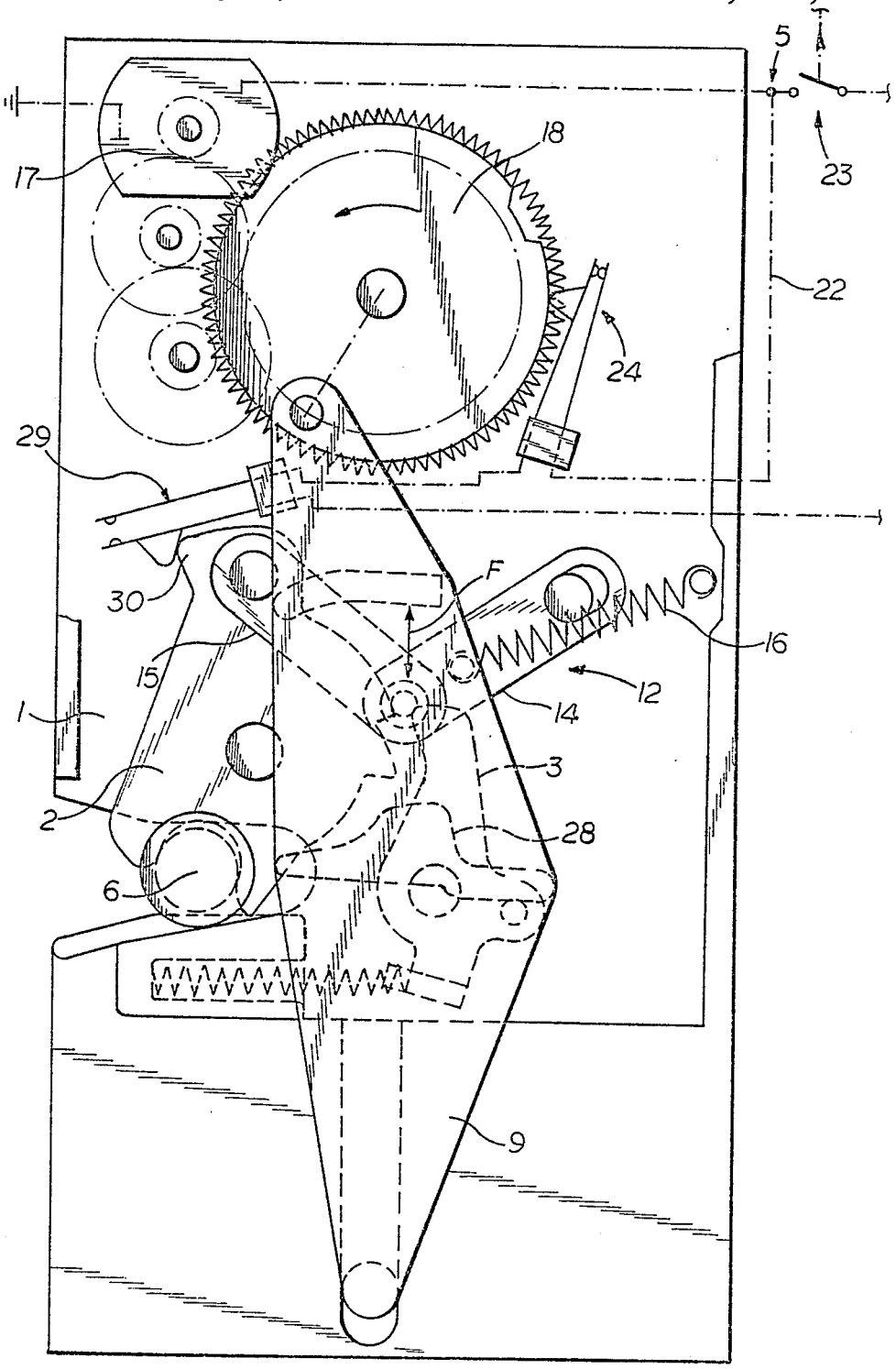
FIG. 5 is yet another view of the lock in a further operative position.

In the embodiments of FIGS. 4 and 5 the system operates similarly to that of FIGS. 1–3 as far as the outer opening operations are concerned. Here, however, the bolt 2 is displaced by the toggle linkage 12 upon movement of the slider 9 and operation of the crank 18 from the open position to the closed position as well i.e. the vehicle door is closed or latched by the electric motor.

In this case, an entraining abutment 28 is provided on the slider 9 and upon upward movement of the latter can engage the toggle linkage 12.

The circuit 22 here includes a further switch 29 which can be cammed closed by the bolt 2 and a projection 30 thereof as a bolt 2 moves into its closed position (compare FIGS. 4 and 5). The switch 29 is in series with the switch 24.

FIG. 4 shows the closed position in which switch 29 is closed while switch 5 shows a position between opening and latching in which the motor is driven when the toggle 12 is in its lower position to ultimately raise the slider 9 and shift the toggle upwardly.

The toggle linkage allows extremely high closing force to be applied to the bolt 2 even by a comparatively small electric motor.

When the door is closed, the engagement of pin 6 in the bolt 2 (FIG. 5) rotates the bolt 2 sufficiently to close the switch 29 and thereupon rotate the crank 18 to latch the pin 6 (FIG. 4).

The system has a lost motion F for the toggle linkage 12 which permits the crank 18 to swing into its upper position and lift the slider 9 into engagement with the toggle for the latching mechanism.

The embodiment of FIGS. 6–10 is functionally similar to that of FIGS. 1–5 and hence similar reference numerals have been utilized to designate the various parts albeit preceded with different hundreds digits (100,200) for the respective embodiments. Consequently, these elements need not be separately described.

In the embodiments of FIGS. 6–10, a single detent or stop 108 is provided on the bolt 102 and serves as a safety detent. The closing operation utilizes a separate stop 7*s* which limits the upward movement of the toggle linkage which might otherwise permit clockwise rotation of the bolt 102.

Figure 6:
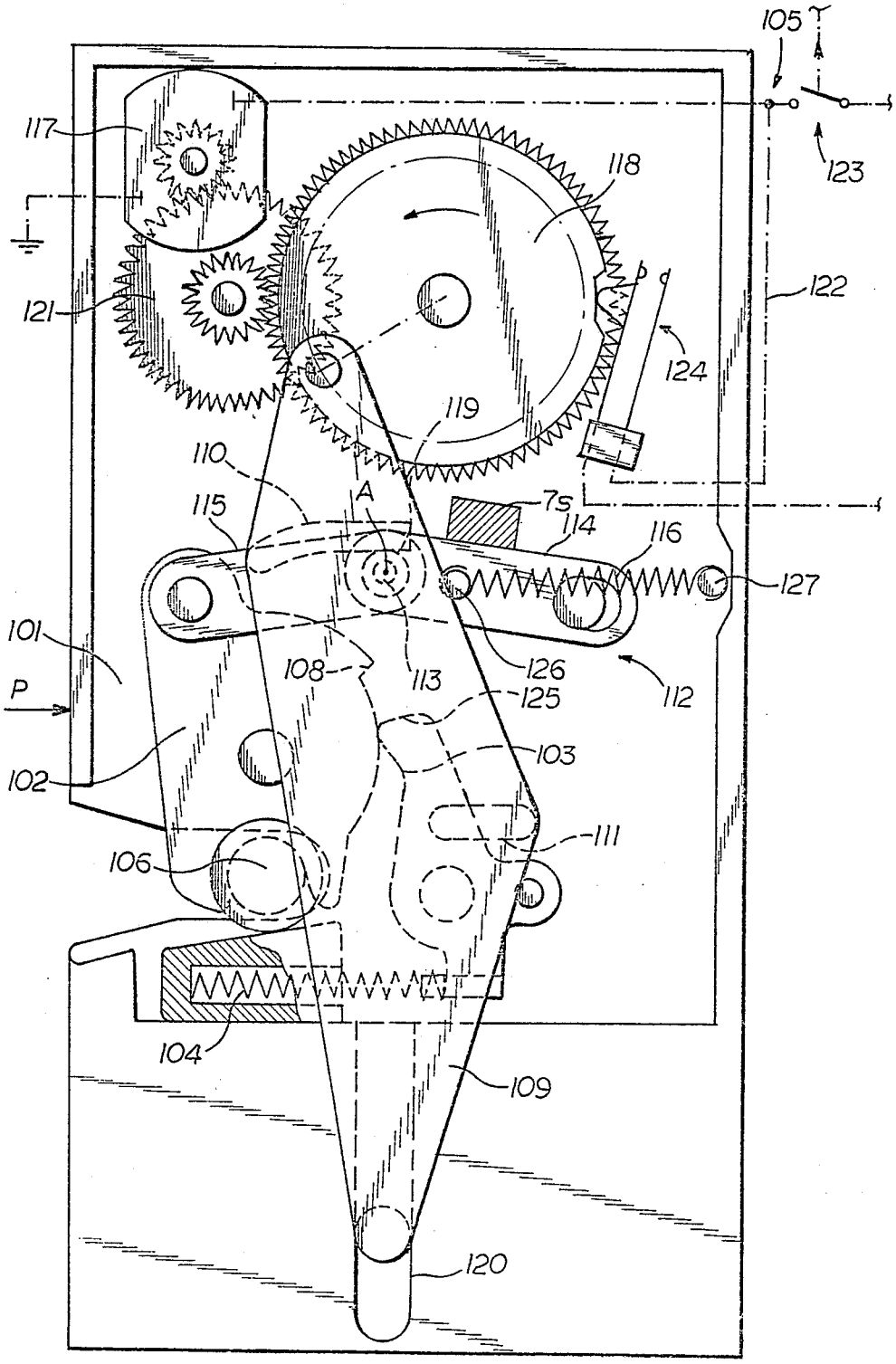
FIG. 6 is a similar view illustrating another embodiment of the invention.
Figure 7:
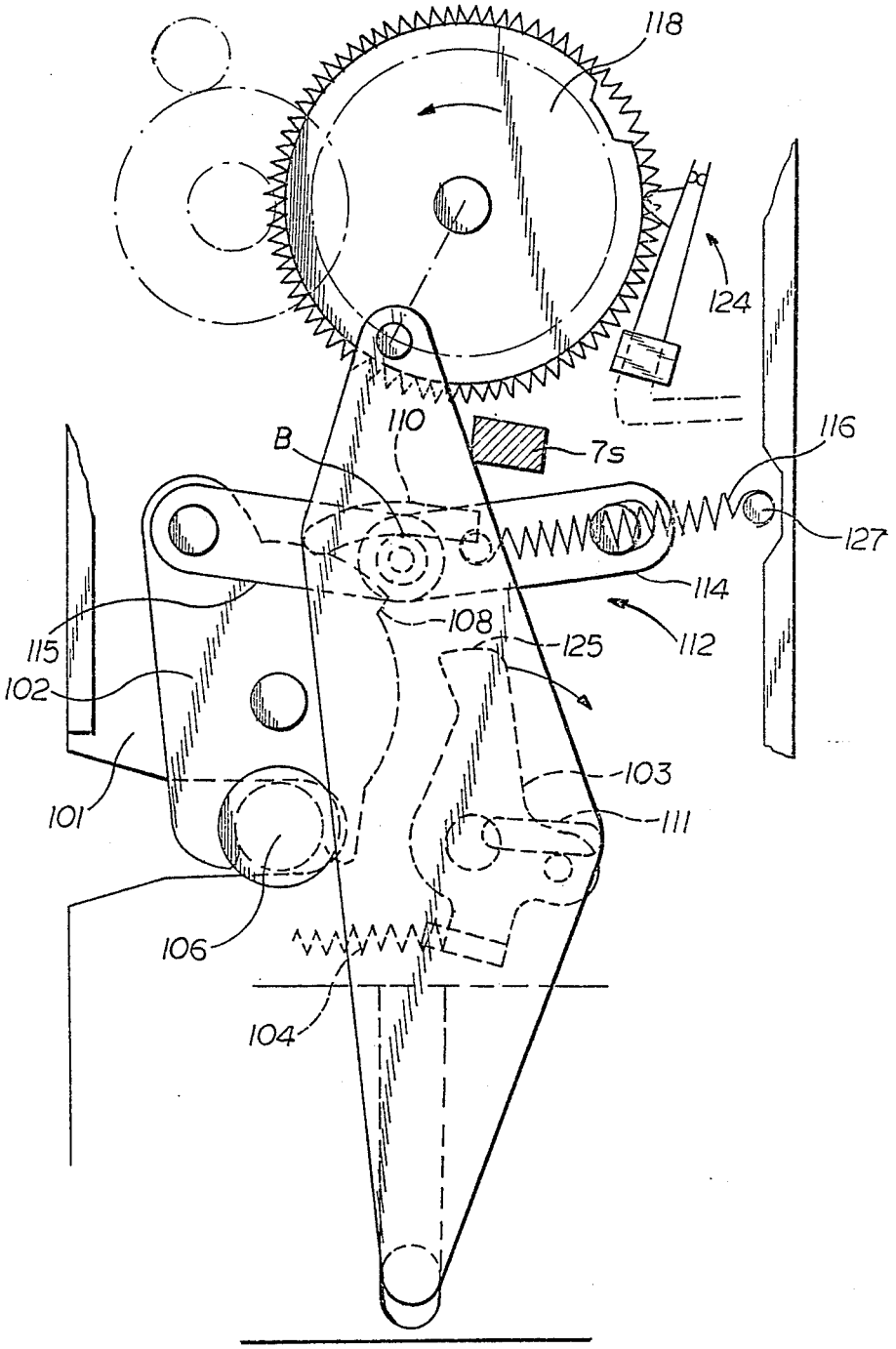
FIG. 7 shows the lock of FIG. 6 fragmentarily and in a further operative position.
Figure 9:
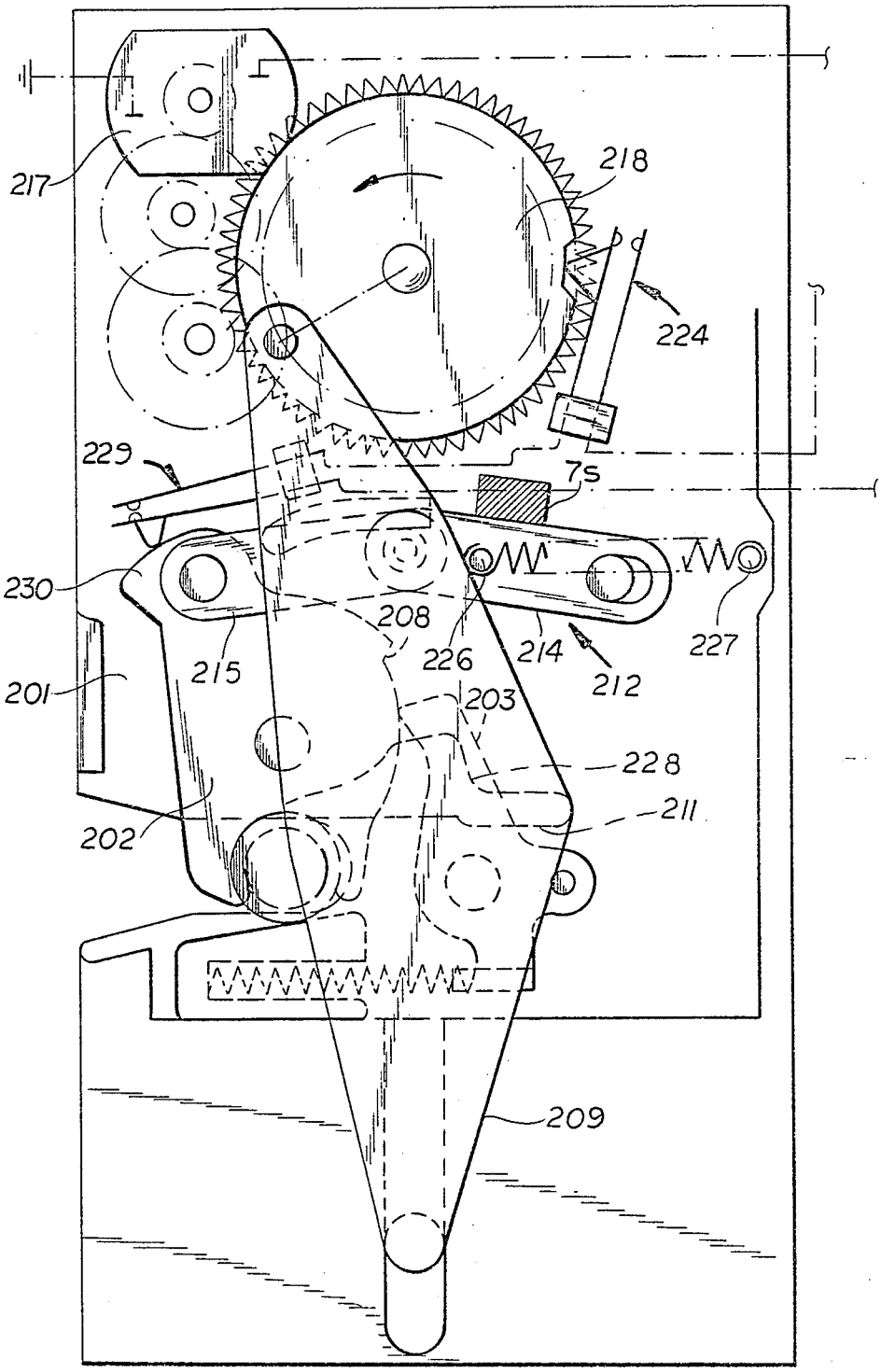
FIG. 9 is a similar view showing the latter lock in a system in which the motor is utilized also to latch the system.
Figure 10:
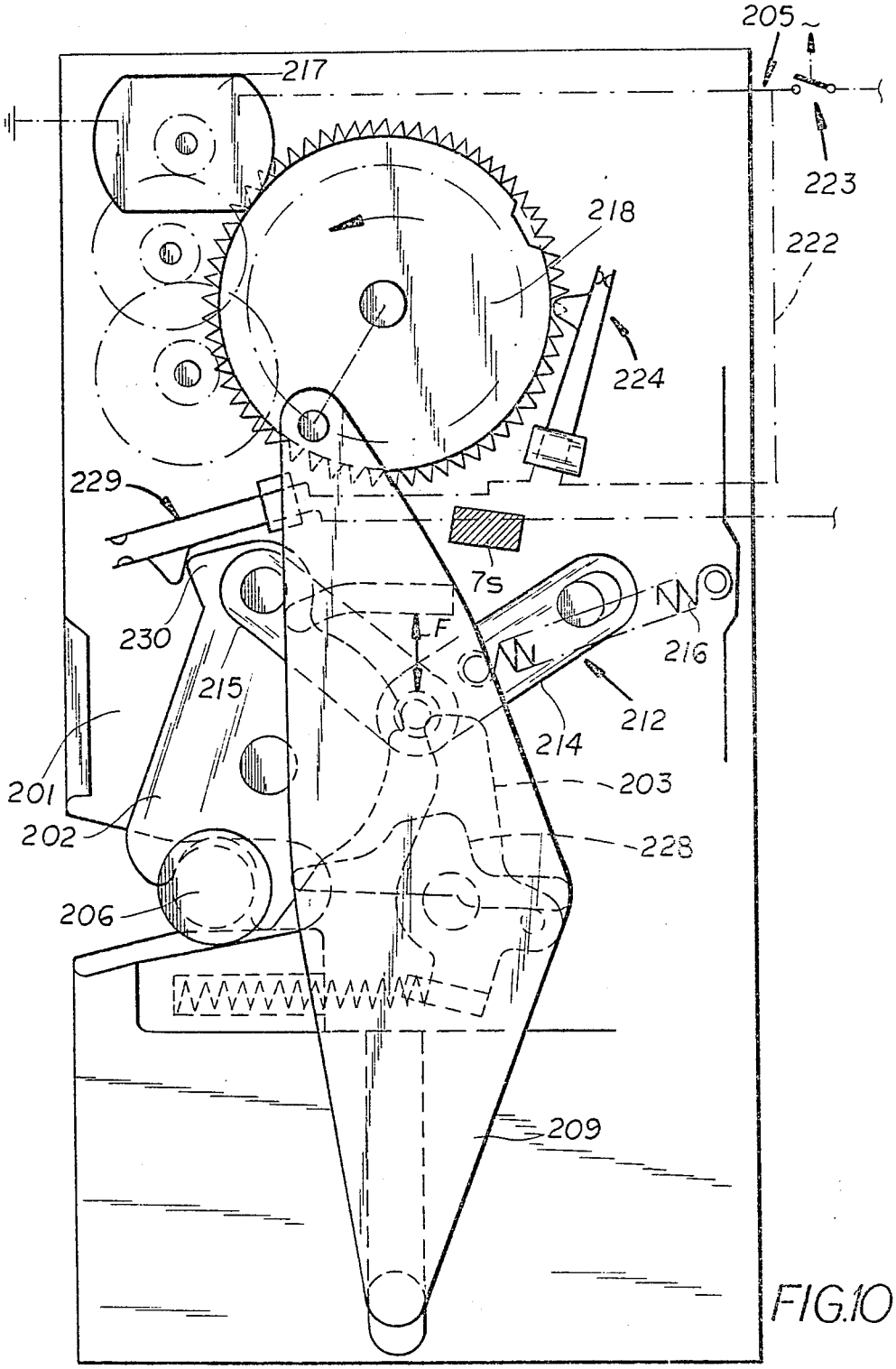
FIG. 10 is a view similar to FIG. 9 showing the lock thereof in another operative position.

In the embodiment of FIGS. 6 and 7, only an unlatching is effected by the power lock whereas the embodiment of FIGS. 9 and 10 provide power latching as well.

Figure 8:
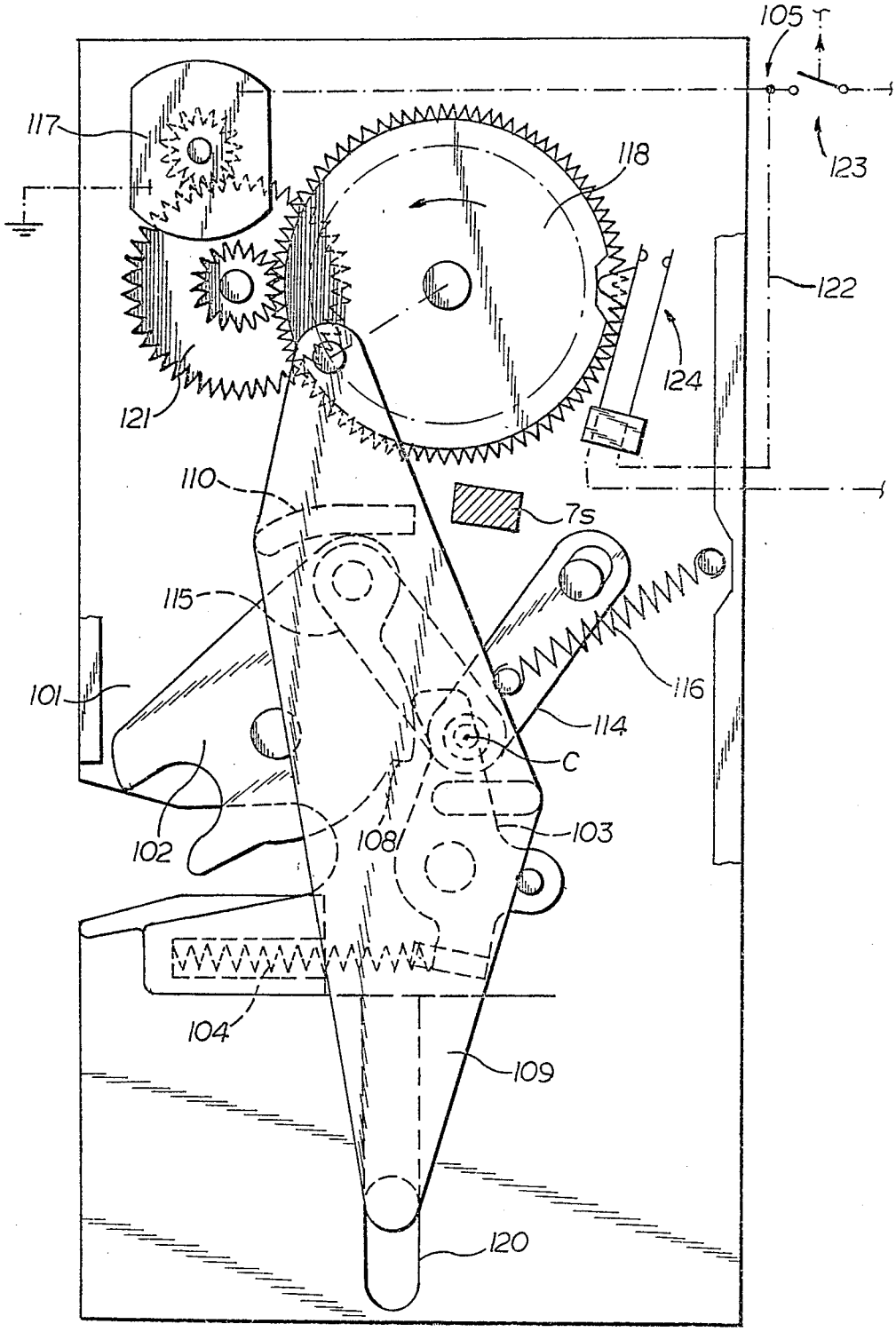
FIG. 8 again shows this lock but in its open position.

Full opening of the bolt is only permitted when the toggle is swung to its lower position C after the detent 108 has cleared the pawl 103 (FIG. 8). The latching position is maintained in part by the force developed by the door seal as previously described, in these embodiments against the stop 7*s*.

We claim:

1. A door-latching mechanism for a vehicle door adapted to cooperate with a pin of a doorpost, said mechanism comprising:

a housing mounted on the door;

a bolt rotatably mounted on said housing and having a fork engageable with said pin, said bolt being rotatable from a locking position wherein said pin is retained against escape from said bolt into an open position wherein said pin can escape from said bolt;

a pawl pivotally mounted on said housing and engageable with said bolt to limit displacement thereof into said open position;

a toggle linkage including a pair of articulated levers connected to said bolt and to said housing, said toggle linkage being shiftable between operative positions on opposite sides of a dead center position for rotating said bolt and having a spring connected between said linkage and said housing for biasing said linkage at least into one of said operative positions;

a slider on said housing provided with at least a pair of abutments including on abutment engageable with said toggle linkage for displacing same from one of its operative positions through said dead center position to the other operative position of said toggle linkage, and another abutment engageable with said pawl for releasing same from its bolt said spring biasing said toggle linkage against said one abutment in said one operative position; and an electric motor driven crank connected to said slider and energizable to displace said slider and shift said one abutment to thereby displace said toggle linkage and rotate said bolt, said crank being so connected to said slider that, upon displacement of said toggle linkage into said other operative position and release of said pawl from said bolt, said spring is effective to rotate said bolt through said linkage to release said pin.

2. The door-latching mechanism defined in claim 1 wherein said housing is formed with a longitudinal slot in which said slider is guided for movement with an amplitude determined by the displacement amplitude of said crank.

3. The door-latching mechanism defined in claim 1, further comprising a speed reducing gear transmission between said crank and an electric motor driving same.

4. The door-latching mechanism defined in claim 1 wherein said crank is provided with a unidirectional electric motor, a cam, a switch operated by said cam and circuit means connected to said switch and said motor for energizing same for rotation of said cam through 360° upon energization of said motor.

5. The door-latching mechanism defined in claim 4, further comprising a further switch operable by said bolt and effective upon rotation of said slider through a lost motion for energizing said motor to shift said bolt from said open position to said closed position.

6. The door-latching mechanism defined in claim 1, further comprising blocking means limiting the movement of said toggle linkage from dead center in one direction for holding said bolt in a closed position.

7. The door-latching mechanism defined in claim 6 wherein said bolt is formed with only a single detent engageable by said pawl.

8. The door-latching mechanism as defined in claim 1 wherein said bolt is formed with a plurality of detents engageable by said pawl.

9. The door-latching mechanism as defined in claim 1 wherein said slider is provided with abutments for forceably displacing said toggle linkage to both sides of said dead center position.

* * * * *